United States Patent [19]

Tanaka et al.

[11] 3,939,801

[45] Feb. 24, 1976

[54] MAGNETIC BRUSH DEVELOPING APPARATUS

[75] Inventors: Susumu Tanaka, Sakai; Yuji Enoguchi, Osaka; Hidetoshi Kawabata, Tondabayashi, all of Japan

[73] Assignee: Minolta Camera Kabushiki Kaisha, Osaka, Japan

[22] Filed: Aug. 23, 1974

[21] Appl. No.: 500,169

[30] Foreign Application Priority Data

Sept. 10, 1973 Japan ..... 48-106098[U]
Oct. 26, 1973 Japan ..... 48-124143[U]

[52] U.S. Cl. ..... 118/637
[51] Int. Cl.[2] ..... B05B 5/02
[58] Field of Search ..... 118/637; 353/3 DD; 117/17.5; 346/74 ES

[56] References Cited

UNITED STATES PATENTS

| | | | |
|---|---|---|---|
| 3,145,122 | 8/1964 | Streich | 118/637 |
| 3,152,924 | 10/1964 | Wanielista et al. | 117/17.5 |
| 3,392,432 | 7/1968 | Naumann | 118/637 X |
| 3,402,698 | 9/1968 | Kojima et al. | 118/637 |
| 3,457,900 | 7/1969 | Drexler | 118/637 UX |
| 3,626,898 | 12/1971 | Gawron | 118/637 |
| 3,783,828 | 1/1974 | Forgo et al. | 118/637 |
| 3,822,139 | 7/1974 | Westdale | 117/17.5 |

*Primary Examiner*—Ronald Feldbaum
*Attorney, Agent, or Firm*—Wenderoth, Lind & Ponack

[57] ABSTRACT

A magnetic brush developing apparatus for use in a dry process electrophotographic copying apparatus which includes a developing roller rotatably provided adjacent to a movable photoreceptor surface and comprising a rotatable outer cylinder and a plurality of pairs of stationary magnets fixedly disposed around the outer cylinder at predetermined angles from one another with a first pair of the stationary magnets directed toward the photoreceptor and with a second pair directed toward a sump of developing material. In each pair of magnets, especially in the first pair for development, two magnets are spaced from each other at a predetermined distance to form soft magnetic brush bristles for uniform quality of copied images.

7 Claims, 11 Drawing Figures

MAGNETIC BRUSH DEVELOPING APPARATUS

Figure 1:
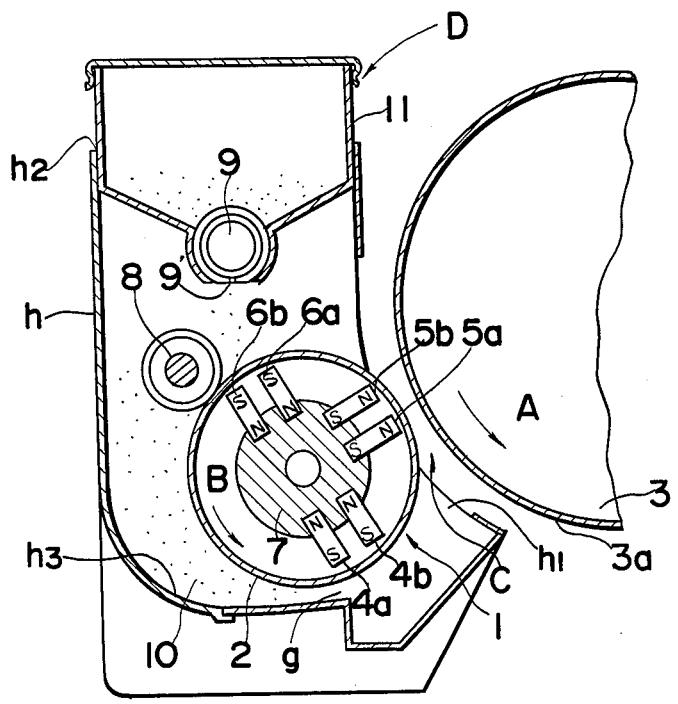

The present invention relates to a dry copying process electrophotographic copying apparatus, and more particularly to a unitary magnetic brush developing apparatus for use therein.

Conventionally, in a dry copying process electrophotographic copying apparatus for xerographic or similar systems, subsequent to projection of a light image of an original to be copied onto a charged photoreceptor surface to form an electrostatic latent image thereon, the latent image is developed at a developing apparatus disposed along the path of the photoreceptor by rubbing the latent image bearing portion of the photoreceptor with magnetic brush bristles of developing material comprising magnetizable carrier material and electroscopic toner powder to develop the latent image into a visible toner powder image for transfer onto a copy paper sheet.

Such a conventional developing apparatus commonly includes a developing roller rotatably provided adjacent to and in spaced relation to the photoreceptor surface, which developing roller further comprises a rotatable outer cylinder and a plurality of single stationary magnets fixedly disposed around the outer cylinder at predetermined angles from one another with one of the stationary magnets directed toward the photoreceptor surface for forming the magnetic brush bristles on the outer cylinder to effect the developing.

Fundamentally, development by a magnetic brush is a development, as described in the above conventional apparatus, in which magnetic brush bristles somewhat undulating at the tips thereof are formed on the surface of the outer cylinder enclosing a plurality of stationary magnets, corresponding to the magnetic lines of force of the stationary magnets with the brush bristles adapted to contact the latent image containing portion on the photoreceptor.

Such a magnetic brush comprises a large number of bristles formed by magnetizable carrier beads with toner particles tribo-electrically adhering to the surface of said beads and with the carrier beads connected to one another as in a chain along the magnetic lines of force of the magnet directed toward the photoreceptor surface for developing.

Since the plurality of stationary magnets are fixedly disposed around the outer cylinder at predetermined angles from one another with alternately different polar orientation in such conventional developing apparatuses, the magnetic fields on the surface of the outer cylinder vary as the outer cylinder rotates with each of the carrier beads transported rotating on its axis.

In the conventional magnetic brush developing apparatus of the above described type, a wide single magnet with strong magnetic force directed toward the photoreceptor surface is employed so as to a form magnetic brush with long bristles on the outer cylinder at the developing position for effecting high speed developing. However, such a single magnet tends to form a magnetic brush with comparatively hard bristles since the distribution of field strength thereof toward the photoreceptor surface to be developed is approximately uniform and constant, which fact results in a hard tone in the developing and a decrease in the quality of the copied image. Furthermore, the magnetic brush with such hard bristles not only has a tendency to scrape toner particles off part of the developed toner powder image and spoil the same, but tends to give copied images of low toner concentration. Although the field strength of such a wide single magnet has a distribution which is approximately uniform and constant, the intensity thereof is strong toward the edges of the same pole, which fact results in strong magnetic lines of force formed between said pole and the opposite pole of the same magnet with some of the brush bristles some what inclined along these magnetic lines of force, affecting adversely or not contributing at all to the developing.

On the contrary, even when rather soft brush bristles are formed by replacing the strong single magnet by a magnet having a comparatively weak magnetic force, the resultant weak magnetic attraction of such a weak magnet for the carrier beads causes not only the toner particles necessary for developing but also the carrier beads to be transferred onto the latent image carrying portion of the photoreceptor, thus seriously deteriorating the quality of the developed image.

Furthermore, in the conventional developing apparatus of the above described type, as the outer cylinder rotates simultaneously with the rotation of the photoreceptor, the brush bristles contact the photoreceptor surface even when the developing is not carried out, thus resulting in soiling of the photoreceptor surface and also deterioration or fatigue of the developing material. In order to remove such disadvantages by suspending the supply of the developing material to the outer cylinder when the developing is not carried out, provision of a scraping plate adapted to contact the surface of the outer cylinder for scraping the developing material therefrom during rotation of the outer cylinder or replacing the stationary magnets enclosed in the outer cylinder with electromagnets which can be de-energized during the time developing is not taking place have been proposed. However, these methods have such disadvantages that in the former, the developing material tends to be fatigued due to heat caused by friction between the scraping plate and the developing material, and in the latter, the developing device unavoidably becomes large and complicated in construction, requiring extra electric power necessary for excitation of the electromagnets and is unsuitable for a copying apparatus of compact size.

It is another disadvantage in the conventional developing device that the magnetic brush bristles formed on the outer cylinder tend to slip on the surface of the outer cylinder due to friction caused by the contact of the bristle tips with the photoreceptor surface or due to distribution of magnetic lines of force of the stationary magnets etc. as the outer cylinder rotates, which trend results in an insufficient supply of the developing material to the photoreceptor and consequent adverse effects on the copied images especially in high speed development.

Accordingly, an essential object of the present invention is to provide a magnetic brush developing apparatus which forms soft magnetic brush bristles so as to maintain uniform copying quality with substantial elimination of the disadvantages inherent in the conventional magnetic brush developing apparatuses.

Another important object of the present invention is to provide a magnetic brush developing apparatus of the above described type which is simple in construction and compact in size, and can be manufactured at low cost.

A further object of the present invention is to provide a magnetic brush developing apparatus of the above described type in which the amount of the developing material to be fed onto the developing roller is properly controlled for preventing any fatigue of the developing material and soiling of the photoreceptor surface.

According to a preferred embodiment of the present invention, the magnetic brush developing apparatus includes a developing roller rotatably disposed adjacent to and in close spaced relation to the photoreceptor surface, which developing roller further comprises a rotatable outer cylinder of non-magnetic material and three pairs of elongated bar magnets fixedly disposed around said outer cylinder at angles of approximately 90° to one another with alternately different polar orientation and with a first pair thereof directed toward the photoreceptor surface for formation of magnetic brush bristles on the outer cylinder. In each pair of the magnets, two magnets of the same dimension and polar orientation are fixedly disposed parallel to and at a predetermined distance from each other to provide a space therebetween. The space between the two magnets is almost free from the influence of magnetic force, since magnetic lines of force of the two magnets with the same polar orientation repel each other at the space and the resultant magnetic brush bristles are much softer than brush bristles formed by a conventional single strong magnet, which fact advantageously eliminates disturbance of the developed toner power image by hard brush bristles during developing as experienced in the conventional device.

Figure 2:
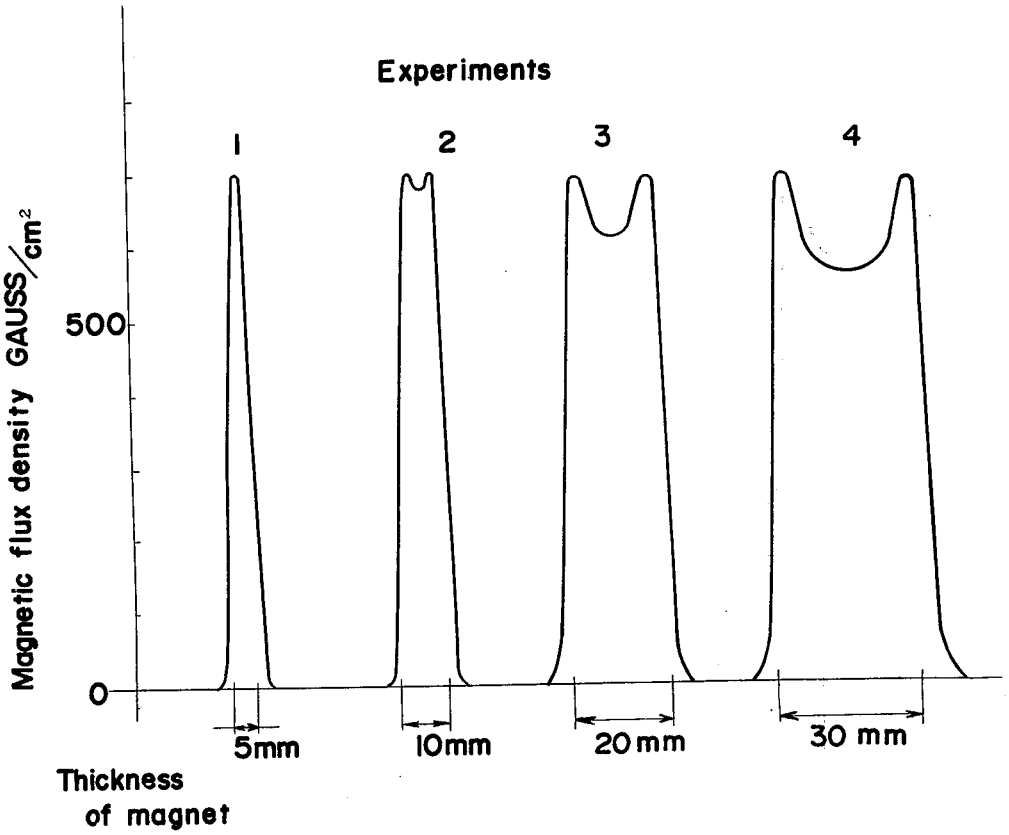
Figure 2:
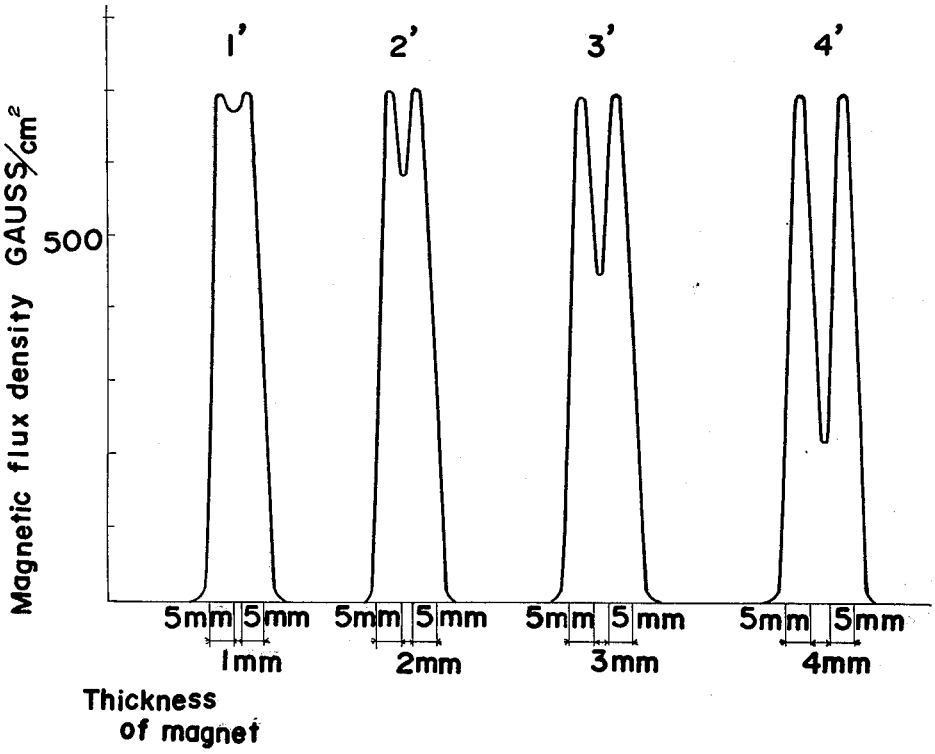
Figure 3:
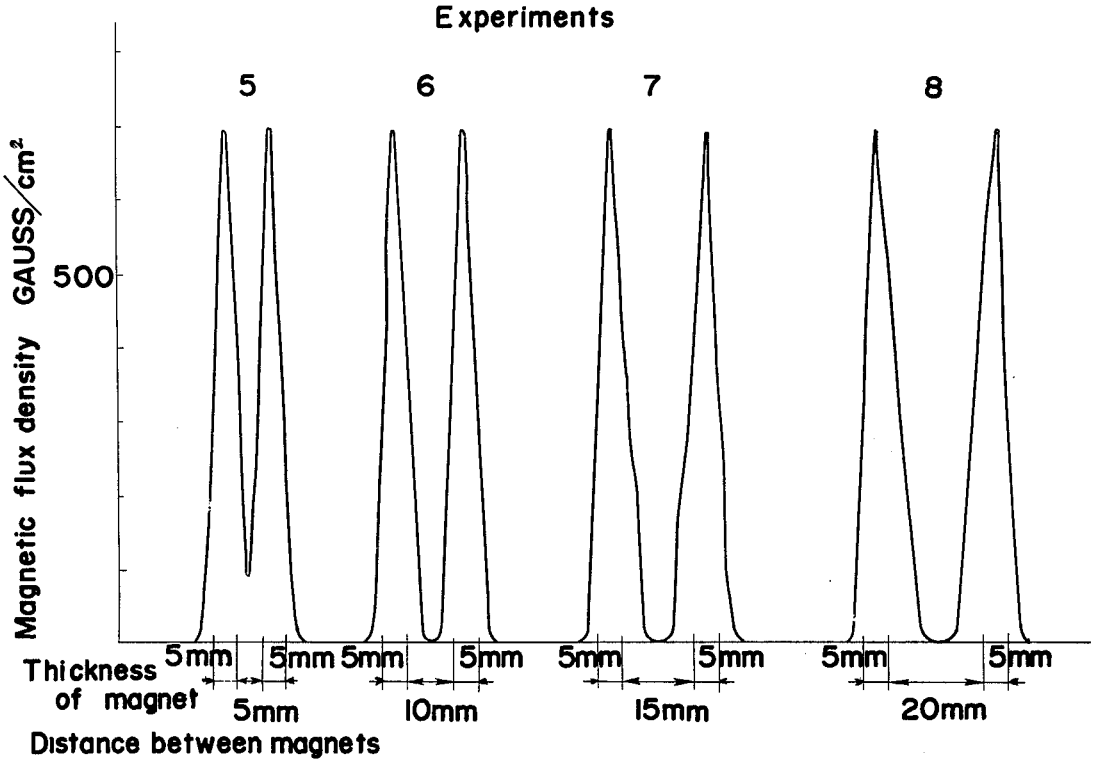
Figure 4:
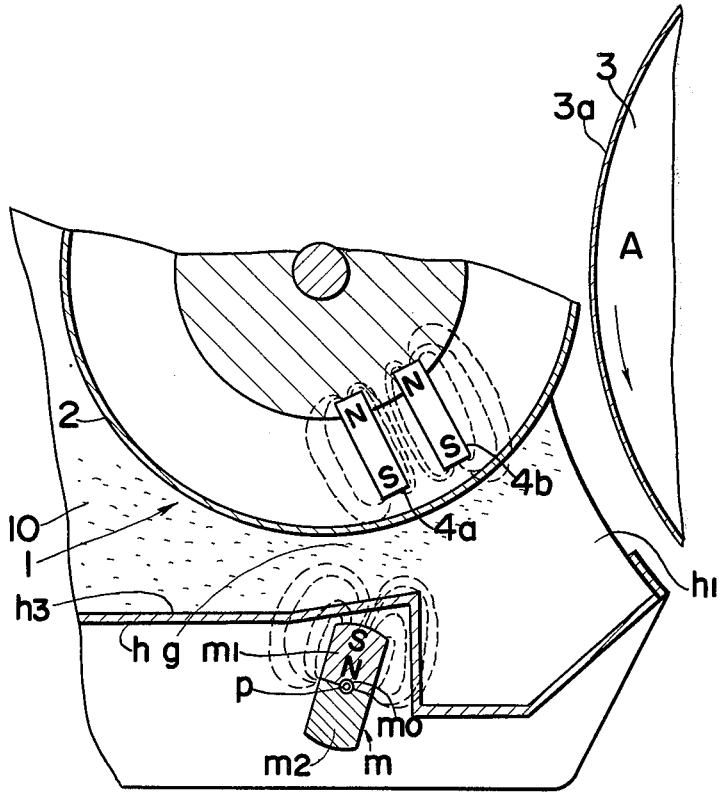
Figure 5:
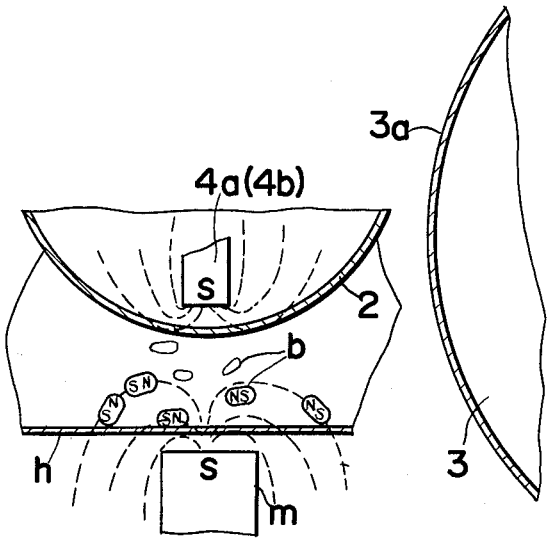
Figure 6:
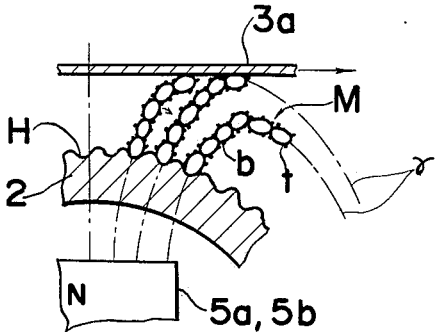
Figure 7:
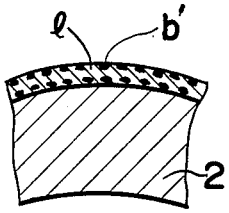
Figure 8:
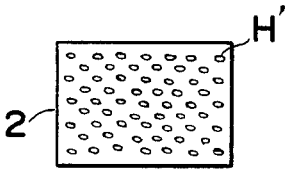
Figure 9:
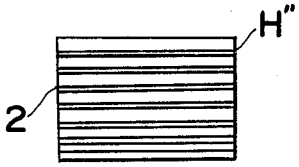
Figure 10:
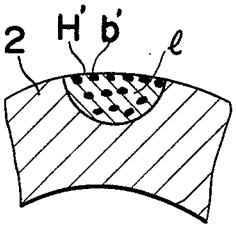

These and other objects and features of the present invention will become apparent form the following description taken in conjunction with the preferred embodiment thereof with reference to the accompanying drawings, in which;

FIG. 1 is a schematic cross sectional view of a magnetic brush developing apparatus according to an embodiment of the invention, FIGS. 2, (*a*) and (*b*), are graphs showing distribution of magnetic flux density of single magnets, FIG. 3 is a graph showing distribution of magnetic flux density of magnets in pairs, FIG. 4 is a schematic cross sectional view, in partial section, showing a modification of the developing device of FIG. 1, FIG. 5 is a schematic cross sectional view explanatory of the principle of the modification of FIG. 4, FIG. 6 is a schematic cross sectional view, in partial section, explanatory of the principle of the surface finish of a developing roller of the invention, FIG. 7 is a schematic cross sectional view, in partial section, of a modification of the surface finish of the developing roller of FIG. 1, FIG. 8 is a top plan view of a section of another modification of the surface finish of the developing roller of FIG. 1, FIG. 9 is a similar view to FIG. 8, but shows a third modification of the surface finish of the developing roller of FIG. 1, and FIG. 10 is a schematic cross sectional view, in partial section, of the modification in FIG. 8.

Before the description of the present invention proceeds, it is to be noted that like parts are designated by like numerals throughout the several views of the accompanying drawings.

Referring to FIG. 1, there is shown a magnetic brush bristle developing apparatus D according to the present invention which is disposed adjacent to a known photoreceptor drum 3 having a photoreceptor surface 3a on the outer periphery thereof and rotated in the direction of the arrow A by a conventional means. The developing device D extending the width of the photoreceptor surface 3a is substantially enclosed in a housing h except for an opening h1 adjacent to the photoreceptor surface *3a* whereat the development of an electrostatic latent image formed on the surface *3a* is effected, and an opening *h*2 in which a toner tank 11 is releasably received to replenish toner powder depleted from developing material 10 during development of the electrostatic latent image. At the lower portion of the housing *h*, there is provided a sump *h*3 containing the developing material 10 comprising magnetizable carrier material and electroscopic toner particles. A developing roller 1 is rotatably provided, at a lower portion of the housing h, adjacent to and in close spaced relationship relative to the photoreceptor surface 3*a* through the opening *h*1, which roller 1 comprises an outer cylinder 2 of a nonmagnetic material extending nearly the width of the housing *h* and rotatably journaled in the side walls of said housing *h* so as to be rotated by a suitable driving means (not shown) with three pairs of stationary elongated bar magnets 4*a*, 4*b*, 5*a*, 5*b* and 6*a*, 6*b* enclosed therein.

The outer periphery of the cylinder 2 should preferably be formed with many small concave portions for a friction increasing finish so as to prevent slippage of magnetic brush bristles to be formed on the cylinder 2 during developing.

In each pair of the bar magnets 4*a*, 4*b*, 5*a*, 5*b* and 6*a*, 6*b*, two magnets of the same dimension and the same polar orientation are disposed in parallel to and slightly spaced from each other, while the three pair of magnets 4*a*, 4*b*, 5*a*, 5*b* and 6*a*, 6*b* are fixedly mounted at intervals along the drum of approximately 90° to one another with alternately different polar orientations on a stationary core or bar 7, and with the first pair of the magnets 5*a*, 5*b* for development directed toward the photoreceptor surface 3*a* and the second pair 4*a*, 4*b* directed toward the sump *h*3. A stirring and scraping member 8 of a magnetic material at the configuration of a roller is rotatably provided in a position adjacent to and in contact with the outer cylinder 2 below a slit 9' formed in the bottom of a toner dispensing means 9 held at the lower portion of the toner tank 11.

In this arrangement, the outer cylinder 2 is rotated in the direction of the arrow B, as the photoreceptor surface 3 bearing the electrostatic latent image rotates in the direction of the arrow A with rotation of the drum 3, during which process the outer cylinder 2 picks up the developing material 10 pooled in the sump *h*3 by the attraction of the stationary magnets 4*a*, 4*b* and carries the same toward a developing position C to form magnetic brush bristles of the developing material 10 on the outer periphery of the cylinder 2 first by the action of the magnet 5*a*. The magnetic brush bristles thus formed are adapted to rub, at the tips thereof, against the latent image formed on the photoreceptor surface 3*a* to develop said latent image into a visible toner powder image, after which the developing material 10 in the form of the brush bristles with toner concentration at the tips thereof considerably reduced as a result of the developing reaches a position between the magnets 5a and 5b as the outer cylinder 2 rotates the remaining developing material is momentarily released from the attraction of the magnet 5*a* and the brush bristles collapse and the developing material is stirred uniformly, and is subsequently formed into fresh brush bristles by the action of the neighboring magnet 5b.

The developing material 10 remaining on the outer cylinder 2 after the development is further attracted by the magnets 6*a* and 6*b* and carried forward as the outer cylinder 2 rotates, subsequently being scraped off the surface of the cylinder 2 by the stirring and scraping member 8 so as to be sufficiently stirred and mixed with fresh toner powder from the toner tank 11, and falls into the sump h3 provided at the lower portion of the housing h.

As described above, the magnet means directed toward the photoreceptor surface 3*a* is composed of a pair of stationary magnets 5*a*, 5*b* of the same dimension and the same polar orientation, and it should be noted that the space provided between the two magnets 5*a* and 5*b* plays a very important part for effecting optimum development.

In the developing apparatus of the present invention, it is preferable that the space between the two magnets 5*a*, 5*b* should be in the region from 5 mm to 20 mm, which arrangement will be described in more detail later.

Fundamentally, by disposing the two magnets 5*a* and 5*b* fixedly with the space therebetween as described above, two fields formed by these magnets are distributed toward the photoreceptor surface 3*a*, and although comparatively hard brush bristles are formed by these two magnetic fields, the magnetic lines of force of the two magnets 5*a*, 5*b* of the same polarity repel each other, thus resulting in soft brush bristles on the whole which makes it possible to effect a soft tone of developing.

Accordingly, should the carrier beads of the developing material 10 be transferred onto the latent image bearing portion of the photoreceptor 3*a* from the brush bristles formed by the magnetic force of the first magnet 5*a*, such carrier beads can be retrieved by the magnetic force of the subsequently disposed second magnet 5*b* as the outer cylinder 2 rotates. Furthermore, since hardly any magnetic field strength is present between the magnets 5*a*, 5*b*, the developing material 10 is positively stirred at the developing position during development.

Although in the embodiment of FIG. 1, all of the magnets 4*a*, 4*b*, 5*a*, 5*b* and 6*a*, 6*b* are composed of magnets in pairs respectively, it is sufficient for the purpose of efficient developing to provide only the magnets 5*a* and 5*b* for development as a pair magnets with the rest of the pair of magnets 4*a*, 4*b* and 6*a*, 6*b* being replaced by single magnets as in the conventional apparatuses. However, if all magnets are composed of pairs of magnets as 4*a*, 4*b*, 5*a*, 5*b* and 6*a*, 6*b* in FIG. 1, the developing material 10 is advantageously stirred and transported most positively.

In order to determine the optimum distance between the two developing magnets 5*a* and 5*b*, a series of experiments were carried out by the present inventors under the conditions as described below.

Referring to FIGS. 2(*a*), 2(*b*) and 3, distributions of magnetic flux density for various magnets employed in the experiments are graphically shown.

In these experiments, a photosensitive photoreceptor layer comprising an electrically conductive base having a selenium film layer deposited thereon and further coated with polyvinyl carbazole (P.V.K.) which photoreceptor layer was negatively charged to 800 volts with subsequent exposure to image light rays of an original to be copied for the formation of a latent image thereon, and an outer cylinder for developing having a bias voltage of − 300 volts imparted thereto and adapted to rotate, in a position spaced away from said photoreceptor layer by 3 to 5 mm at a relative surface speed of 40 cm/sec. with the outer cylinder enclosing therein a stationary magnet or a pair of stationary magnets having a predetermined distance therebetween, which magnets were disposed so that the magnetic lines of force thereof were directed toward the photoreceptor layer to give a flux density of 700 gauss/cm$^2$ on the surface of the outer cylinder, and with magnetizable particles closely scattered and fixed on the surface of the outer cylinder by a bonding material as described later, and a developing material composed of magnetizable carrier beads of 200 to 300 mesh and electroscopic toner particles were employed for experimental developing of the latent image formed on said photoreceptor layer with subsequent transfer of the developed toner powder image onto a copy paper sheet for assessing the quality of the transferred image.

In the following experiments, the above conditions remained the same with the thickness of magnets and the distance between the magnets varied in each experiment as shown below.

| Experiment No. | Single magnet (thickness) | Magnets in pair (thickness) | distance betwen two magnets) |
|---|---|---|---|
| 1 | 5 mm | — | — |
| 2 | 10 mm | — | — |
| 3 | 20 mm | — | — |
| 4 | 30 mm | — | — |
| 1′ | — | 5 mm | 1 mm |
| 2′ | — | 5 mm | 2 mm |
| 3′ | — | 5 mm | 3 mm |
| 4′ | — | 5 mm | 4 mm |
| 5 | — | 5 mm | 5 mm |
| 6 | — | 5 mm | 10 mm |
| 7 | — | 5 mm | 15 mm |
| 8 | — | 5 mm | 20 mm |

In the above experiments 1 to 4 using single magnets of different thickness, since toner particles once applied to the latent image formed portion of the photoreceptor surface by the magnetic brush bristles tend to be scraped off by the hard brush bristles, the density of the copied image on the copy paper sheet was generally decreased, the maximum density of which was only in the region of 0.9 to 1.0. Moreover, as the scraping off of the toner particles by the hard brush bristles varied from part to part on the toner powder image, uneveness in density in the form of scratching was observed on the copied image in the scanning direction by the magnetic brush bristles.

The graphs in FIG. 2(*a*) illustrate the magnetic fields of single magnets of different thickness at poles thereof adjacent to the inner periphery of the cylinder 2, from which it will be seen that the magnetic fields fall only to a slight extent at the middle portions, resulting in hard brush bristles as in the conventional developing apparatuses.

In the experiments 1′ to 4′ illustrated in the graphs of FIG. 2(*b*), pairs of magnets spaced from each other by distances from 1 to 4 mm were employed. However, it will be seen from the graphs 1′ to 4′ that the fall of the magnetic fields between the two magnets was still insufficient, although an improving trend is noticed in the graph 4′ with the space of 4 mm.

On the other hand, in the experiments 5 to 8 in FIG. 3 employing a pair of magnets spaced from each other in the range from 5 mm to 20 mm, the defect as described above was eliminated, since the magnetic brush bristles formed were rather soft because of the presence of the space almost free from the effect of magnetic lines of force, and clear and definite copied images with maximum density of 1.4 to 1.5 were obtained.

Sharp falls of the magnetic fields noticed in the graphs of FIG. 3 illustrate the absence of magnetic influence in the space between the two magnets which is effective for the formation of the soft brush bristles in the developing apparatus of the invention.

From the above description, it will be noticed that the distance between the two magnets 5*a* and 5*b* should be in the range from 5 mm to 20 mm to obtain the optimum developing results in the developing apparatus of the present invention.

A further experiment carried out by the present inventors using an outer cylinder 2 of 60 mm in diameter, stationary magnets 5*a* and 5*b* each 5 mm thick and 15 mm high with a distance of 5.5 mm between the magnets 5*a* and 5*b*, and with magnetic flux density of 800 gauss/cm$^2$ at the surface of the outer cylinder showed a better developing result than the result in a similar experiment under the same conditions as above with the magnets 5*a* and 5*b* replaced by a single magnet 10 mm thick and 10 mm high.

As is clear from the above description, in the developing device of the present invention, the provision of the pair of magnets 5*a* and 5*b* for developing spaced from each other at a predetermined distance in the region from 5 mm to 20 mm and directed, with the same polar orientation, toward the developing position on the photoreceptor surface is very advantageous in sufficiently stirring the developing material during the developing and forming comparatively soft magnetic brush bristles without spoiling by hard brush bristles, the toner powder image once formed on the photoreceptor surface, thus improving the developing efficiency and the quality of copied images to a large extent. Moreover, since two thin magnets can be employed as the developing magnets, the cost of the developing device is considerably reduced.

Referring to FIGS. 4 and 5 there is shown a modification of the embodiment of FIG. 1. In this modification, a control member *m* for the developing material in the form of a bar is rotatably mounted on the side wall of the housing *h*, by a pin *p* through an opening *mo* formed in the middle portion of the member *m*, at a position below the sump *h*3 approximately opposite the stationary magnets 4*a* and 4*b* for transporting the developing material, with the pin *p* extending parallel to the axis of the outer cylinder 2.

The member *m* further comprises a strong permanent magnet bar *m*1 and a non-magnetic bar *m*2 fixedly connected at the middle portion of the member *m* so as to form the member *m*, and is adapted to rotate about the pin *p* so that the magnet bar *m*1 is directed toward the magnets 4*a* and 4*b* when the developing is not carried out, while the non-magnetic bar *m*2 is directed toward the magnets 4*a* and 4*b* during developing.

In this arrangement, when the non-magnetic bar portion *m*2 of the member m is directed during development toward the magnets 4*a* and 4*b*, the magnetic force of the magnet *m*1 of the member m does not at all affect the stationary magnets 4*a* and 4*b* enclosed in the cylinder 2, so that the developing material 10 is attracted by the magnets 4*a* and 4*b* and carried forward, as the outer cylinder 2 rotates, to effect development of the latent image on the photoreceptor surface 3*a* as earlier described.

On the contrary, if the member m is rotated through an angle of 180° to allow the magnet *m*1 to face the magnets 4*a* and 4*b* when the development is not to be carried out, the magnetic lines of force of the stationary magnets 4*a* and 4*b* and those of the permanent magnet *m*1 repel each other with the former almost disappearing in the vicinity of the cylinder 2, in which case, even if outer cylinder 2 rotates, carrier beads *b* of the developing material 10, slip off the surface of the cylinder 2 without being transported toward the photoreceptor 3*a* as shown in FIG. 5, the carrier beads *b* present in the neighborhood of the magnet *m*1 being attracted by the magnet *m*1.

The stationary magnets 4*a* and 4*b* described as employed in the above modification may be replaced by a single magnet, in which case, however, a magnet of large size with a strong magnetic force is required for sufficient transportation of the developing material 10, and consequently the magnet *m*1 should also be one of large size with a powerful magnetic force to overcome the strength of the single magnet, thus resulting in a large size of the developing device itself and consequent higher cost.

Accordingly, the magnet means 4 is preferably a pair of magnets spaced from each other as at 4*a* and 4*b* toward which the magnet *m*1 is adapted to face as described in the modification of FIG. 4, since, in the above arrangement, the magnet *m*1 may be one of small size having a magnetic force equivalent to one of the magnets 4*a* and 4*b*.

Furthermore, if a passage *g* (FIG. 4) for the developing material 10 formed between the sump *h*3 and the lower periphery of the cylinder 2 is further narrowed for increasing the influence of the magnetic force of the magnet *m*1, not only can a smaller magnet be used for the magnet *m*1 for the control of the developing material 10, but the length of the magnetic brush bristles formed on the surface of the cylinder 2 can be regulated by the height of the passage *g*.

As is clear from the above description, according to the modification of the invention as described above, since the supply of the developing material toward the photoreceptor is controlled, depending upon the developing operation, by the control member of simple construction and compact size rotatably provided below the sump of a developing material at the position, opposite the stationary magnets for developing material transportation, the soiling of the photoreceptor surface due to the contact by the magnetic brush bristles when the developing is not carried out and deterioration and fatigue of the developing material inherent in the conventional means are completely eliminated.

Referring now to FIGS. 7 to 10, there are shown modifications of the finish for increasing friction on the outer periphery of the cylinder 2 of FIG. 1.

Before the description of the above modifications of the invention proceeds, it is to be noted that these modifications in FIGS. 7 to 10 are based on the fact described below.

In FIG. 6, the provision of the concave portions H on the outer periphery of the outer cylinder 2 for increasing friction between the carrier beads *b* carrying toner particles *t* of the developing material and the surface of the cylinder 2 still allows the magnetic brush bristles M to slip off the surface of the cylinder 2 to a certain extent due to frictional force resulting from the contact of the brush bristles M with the photoreceptor surface 3*a* if the speed of rotation of the outer cylinder 2 or the photoreceptor surface 3*a* is increased, even in which case, however, the brush bristles M still remain formed approximately along the magnetic lines of force $\gamma$ of the magnets 5*a* and 5*b*. This is because each of the carrier beads *b* is magnetized by the magnetic force of the magnet 5*a* or 5*b* and is formed into a small magnet with the attraction between the carrier beads *b* being larger than the attraction between the carrier beads *b* and the outer cylinder 2.

In FIG. 7, a mixture of magnetizable particles *b'* of iron, iron oxide or various kinds of ferrite particles having a diameter of 10 to 500 $\mu$ and a bonding material *l* of alkyd resin, acrylic resin, polyvinyl acetate, or thermosetting epoxy resin with the quantity of the latter being in the range of 1/5 to 1/10 of the former by weight is diluted by a resin solvent and applied onto the surface of the outer cylinder 2 to a thickness of approximately 0.05 to 0.5 mm with subsequent drying so as to fix the magnetizable particles *b'* in a closely scattered array on the surface of the cylinder 2.

By the above arrangement, since the fixed magnetizable particles *b'* are magnetized by the stationary magnets 5*a* and 5*b* so as to form small magnets which locally disturb the magnetic field on the surface of the cylinder 2 and attract the carrier beads *b* of the magnetic brush bristles as strongly as the attraction between the carrier beads *b* in the brish bristles, no slipping between the brush bristles and the surface of the cylinder 2 is caused even when the tips of the brush bristles contact the photoreceptor surface 3*a*.

Furthermore, in the above modification of the invention, as the brush bristles are positively formed at the positions of the fixed magnetizable particles *b'* magnetized in advance, the density of the formed brush bristles is much less than in conventional means so as to provide sufficient quantity of developing material to the developing position together with the effect of preventing slippage of the brush bristles, thus eliminating the possibility of producing copied images of excessively light shade which may result from the fact that the number of brush bristles formed is limited because the carrier beads *b* attracted onto the cylinder 2 tend to repel other carrier beads *b* present in the vicinity thereof to prevent the latter from adhering to the surface of the cylinder 2.

In FIGS. 8 and 9, many concave portions or dents H' or splines H'' are formed on the entire outer periphery of the cylinder 2 instead of the layer of the mixture of the magnetizable particles *b'* and the bonding material *l* uniformly formed on the cylinder 2 in the modification in FIG. 7. The dents H' or the splines H'' are filled with the mixture of magnetizable particles *b'* and bonding materail *l* as shown in FIG. 10 with the excessive mixture on the surface of the cylinder 2 wiped off thereafter, thus, fixing the particles *b'* in a scattered array in the dents H' or the splines H''.

It should be noted here that the proper depth of each of the dents H' or the splines H'' is in the region from 0.1 to 3 mm, and that the dents H' should be formed evenly over the entire surface of the cylinder 2 in the direction of rotation of the cylinder 2, for example, in a zigzag pattern for obtaining uniform copied images.

In the above modifications in FIG. 7 to 9, it is necessary to employ the magnetizable particles *b'* having a diameter equal to or slightly larger than the diameter of the carrier beads *b* for the developing material 10, and also to properly scatter the magnetizable particles *b'* so as not to reduce the magnetic force of the stationary magnets 5*a* and 5*b* through the cylinder 2 by a shielding action of the fixed particles *b'*. If the surfaces of the magnetizable particles *b'* are adapted to be exposed on the surface of the cylinder 2, the magnetic force of the particles *b'* is strengthened with improved attraction toward the carrier beads *b* for magnetic brush formation.

As is clear from the above description, according to the modifications of the surface finish of the outer cylinder of the invention shown in FIGS. 7 to 9, the slippage of the magnetic brush bristles formed on the rotating outer cylinder during development is advantageously prevented with improved adhesion of the developing material to the photoreceptor surface by simply scattering magnetizable carrier particles on the entire surface of the outer cylinder or in the concave portions formed on the outer periphery of the outer cylinder, which surface finish provides a developing cylinder particularly suitable for high speed development.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. In a magnetic brush developing apparatus for use in an electrophotographic copying apparatus which has a housing, and a developing roller rotatably provided adjacent to and in close spaced relation to a movable photoreceptor surface on which an electrostatic latent image on an original to be copied is formed, said developing roller including a rotatable outer cylinder and magnet means fixedly enclosed in said outer cylinder and disposed in such a position that the magnetic field of said magnet means intersects said cylinder to form magnetic brush bristles of developing material on said outer cylinder for developing said latent image into a visible toner powder image, the improvement in which, for forming soft magnetic brush bristles on said outer cylinder to maintain uniform quality of copied images, said magnet means comprises a pair of stationary magnets directed with the same polar orientation toward the photoreceptor surface and disposed in parallel to and at a distance from 5 to 20 mm from each other, said distance providing a space between said two magnets in which space magnetic lines of force of said two magnets repel each other with said space almost free from influence of said magnetic lines of force of said two magnets.

2. A magnetic brush developing apparatus as claimed in claim 1, wherein said two magnets are of the same dimension.

3. In a magnetic brush developing apparatus for use in an electrophotographic copying apparatus which has a housing, a developing roller rotatably provided adjacent to and in close spaced relation to a movable photoreceptor surface on which an electrostatic latent image of an original to be copied is formed, said developing roller including a rotatable outer cylinder having an outer periphery thereof finished to increase friction and a plurality of stationary magnet means enclosed in said outer cylinder and disposed in such positions that magnetic fields of such magnet means intersect said outer cylinder to attract and feed developing material into said outer cylinder so as to form magnetic brush bristles on said outer cylinder for developing the electrostatic latent image formed on said photoreceptor surface into a visible toner powder image, a toner dispensing means provided above said outer cylinder for replenishing said developing material with fresh toner powder, and a sump for said developing material provided at a lower portion of said housing below said developing roller, the improvement in which, for forming soft magnetic brush bristles on said outer cylinder with controlled supply of developing material to said outer cylinder for uniform quality of copied images, each magnet means comprises a pair of stationary magnets fixedly disposed on said outer cylinder at a predetermined angle from one another with alternately different polar orientation and with a first pair of said magnets directed toward said photoreceptor surface and a second pair thereof directed toward said sump for attraction and transportation of said developing material, in each of which pairs of magnets the two magnets have the same dimension and the same polar orientataion and are fixedly disposed in parallel to and at a distance from each other, said first pair of magnets directed toward the photoreceptor surface being spaced at a distance of from 5 to 20 mm and acting as magnets for effecting development by forming magnetic brush bristles of said developing material on said outer cylinder at a position immediately above said first pair of magnets.

4. A magnetic brush developing apparatus as claimed in claim 3, wherein said developing roller is further provided with a control member rotatably mounted below said sump approximately facing said second pair of magnets directed toward said sump, said control member comprising a strong magnet bar and a non-magnetic bar fixedly connected to each other at a middle portion of said control member at which middle portion said control member is rotatably supported on a side wall of said housing so that said magnet bar can be directed toward said second magnets when said developing is not carried out and said non-magnetic bar can be directed toward said second magnets during said developing.

5. A magnetic brush developing apparatus as claimed in claim 3, wherein said outer periphery of said outer cylinder is coated with a mixture of magnetizable particles and a bonding material so as to fix said magnetizable particles in a closely scattered array on said outer periphery of said outer cylinder for increasing friction.

6. A magnetic brush developing apparatus as claimed in claim 3, wherein said outer periphery of said outer cylinder is provided with a large number of concave portions which are filled with a mixture of magnetizable particles and a bonding material so as to fix said magnetizable particles scattered on said outer periphery of said outer cylinder for increasing friction.

7. A magnetic brush developing apparatus for use in an electrophotographic copying apparatus comprising;

a developing roller rotatably provided adjacent to and in close spaced relation to a movable photoreceptor surface on which an electrostatic latent image of an original to be copied is formed, said developing roller including a rotatable outer cylinder and at least three magnet means fixedly enclosed therein, one of said three magnet means including a pair of stationary magnets having the same polar orientation and the same dimensions and separated by a distance of about 5 to 20 mm so that the magnetic lines of force of said two magnets repel each other with the space defined by said distance almost free from the influence of said magnetic lines of force of said two magnets, said pair of magnets facing the photoreceptor surface for developing the image formed thereon and having a polar orientation opposite from the remaining magnet means.

* * * * *